US010081456B2

(12) United States Patent
Wagner

(10) Patent No.: US 10,081,456 B2
(45) Date of Patent: Sep. 25, 2018

(54) DECORATIVE GIFT BAG INSERT

(71) Applicant: Cole & Ashcroft, L.P., Houston, TX (US)

(72) Inventor: Paul F. Wagner, Houston, TX (US)

( * ) Notice: Subject to any disclaimer, the term of this patent is extended or adjusted under 35 U.S.C. 154(b) by 0 days.

(21) Appl. No.: 15/109,225

(22) PCT Filed: Dec. 31, 2014

(86) PCT No.: PCT/US2014/072948

§ 371 (c)(1),
(2) Date: Jun. 30, 2016

(87) PCT Pub. No.: WO2015/103368

PCT Pub. Date: Jul. 9, 2015

(65) Prior Publication Data

US 2016/0318664 A1 Nov. 3, 2016

Related U.S. Application Data

(60) Provisional application No. 61/922,956, filed on Jan. 2, 2014.

(51) Int. Cl.

| | |
|---|---|
| ***B65D 1/42*** | (2006.01) |
| ***B65D 33/00*** | (2006.01) |
| ***B65D 33/02*** | (2006.01) |

(52) U.S. Cl.
CPC ..... *B65D 33/004* (2013.01); *B65D 33/02* (2013.01)

(58) Field of Classification Search
CPC .. B65D 33/004; B65D 5/425; B65D 2203/00; B65D 25/16
USPC ..... 220/651
See application file for complete search history.

(56) References Cited

U.S. PATENT DOCUMENTS

| | | | |
|---|---|---|---|
| D32,242 | S | 2/1900 | Schaefer et al. |
| 1,628,429 | A | 5/1927 | Radford |
| 1,907,082 | A | 5/1933 | Meltzer |
| 3,081,474 | A | 3/1963 | Modrak |
| D228,077 | S | 8/1973 | MacKenzie |
| 4,055,840 | A | 10/1977 | Uchytil |
| D259,354 | S | 5/1981 | Derrington |
| D265,409 | S | 7/1982 | Braasch |
| D284,487 | S | 7/1986 | Pratt |
| 4,608,283 | A | 8/1986 | White |

(Continued)

FOREIGN PATENT DOCUMENTS

| | | |
|---|---|---|
| WO | 2014/137481 | 9/2014 |

OTHER PUBLICATIONS

Weyand, T., International Search Report for International Patent Application No. PCT/US2014/072948, dated Apr. 14, 2015, European Patent Office.

(Continued)

*Primary Examiner* — Shawn M Braden

(57) ABSTRACT

A device for enhancing the appearance and physical stability of a gift bag is described, the device being insertable within a gift bag. The device includes an upper, cut section that extends from the top of the bag to cover the gift bag from the inside and simultaneously add decoration, while the uncut portion is expanded upon insertion into the bag to provide support to the gift bag and keep the bag in an open configuration. The device is adjustable in height to allow it to accommodate a variety of gift bag sizes.

20 Claims, 6 Drawing Sheets

(56) References Cited

U.S. PATENT DOCUMENTS

| | | | | |
|---|---|---|---|---|
| 4,808,446 | A | 2/1989 | Weitz | |
| 4,932,556 | A | 6/1990 | Hui | |
| D319,419 | S | 8/1991 | Cheng | |
| D319,605 | S | 9/1991 | Jenks | |
| 5,084,308 | A | 1/1992 | Luk | |
| 5,265,727 | A * | 11/1993 | Anderson | B65D 75/002 206/457 |
| D342,219 | S | 12/1993 | Cheng | |
| 5,441,348 | A | 8/1995 | Valentino | |
| 5,609,928 | A | 3/1997 | Yedlin | |
| D386,719 | S | 11/1997 | Cheng | |
| D387,527 | S | 12/1997 | Specht | |
| D414,722 | S | 10/1999 | Hamowy | |
| 6,017,596 | A | 1/2000 | Deraney | |
| D429,281 | S | 8/2000 | Miller | |
| D433,960 | S | 11/2000 | Chen | |
| 6,146,018 | A | 11/2000 | Keller | |
| 6,237,819 | B1 | 5/2001 | Ramirez | |
| D444,416 | S | 7/2001 | Ramirez | |
| 6,450,933 | B1 | 9/2002 | Gruenke | |
| D464,261 | S | 10/2002 | Hereth | |
| D476,920 | S | 7/2003 | Price et al. | |
| 6,676,053 | B2 * | 1/2004 | Cook | B02C 18/0007 241/223 |
| D495,273 | S | 8/2004 | Cheng | |
| D496,509 | S | 9/2004 | Petner | |
| 6,824,719 | B2 | 11/2004 | Weder et al. | |
| 6,877,704 | B2 * | 4/2005 | Novak | B44C 5/00 248/346.01 |
| D521,393 | S | 5/2006 | Pernell | |
| D521,875 | S | 5/2006 | Barton | |
| D522,381 | S | 6/2006 | Barton | |
| D530,133 | S | 10/2006 | Wilkins | |
| D549,590 | S | 8/2007 | Mauerhan | |
| D551,410 | S | 9/2007 | Petner | |
| D555,739 | S | 11/2007 | Brown | |
| 7,308,864 | B1 * | 12/2007 | Catner | G09F 17/00 116/173 |
| D562,515 | S | 2/2008 | Treacy | |
| 7,364,042 | B2 | 4/2008 | Weder | |
| D573,061 | S | 7/2008 | Chung | |
| D605,830 | S | 12/2009 | Beckwith | |
| D615,729 | S | 5/2010 | Beckwith | |
| D617,205 | S | 6/2010 | Hernandez | |
| D617,552 | S | 6/2010 | Martin, Jr. | |
| D617,675 | S | 6/2010 | Underhill | |
| D666,771 | S | 9/2012 | Yadav | |
| 8,375,502 | B2 | 2/2013 | Scott | |
| 8,757,430 | B2 | 6/2014 | Weber | |
| D715,183 | S | 10/2014 | Blaser | |
| D730,742 | S | 6/2015 | Glass | |
| D750,995 | S | 3/2016 | Mitchell | |
| D752,477 | S | 3/2016 | Wagner | |
| 2002/0185407 | A1 | 12/2002 | Kronenberger | |
| 2003/0015640 | A1 | 1/2003 | Novak | |
| 2004/0078911 | A1 | 4/2004 | Alexander | |
| 2007/0039849 | A1 | 2/2007 | Rodriguez | |
| 2009/0123681 | A1 | 5/2009 | Weder | |
| 2009/0136162 | A1 | 5/2009 | Lazarus | |
| 2011/0058756 | A1 | 3/2011 | Underhill | |
| 2014/0193104 | A1 * | 7/2014 | Middlemas | B65D 33/004 383/109 |
| 2014/0194268 | A1 * | 7/2014 | Middlemas | D04D 5/00 493/394 |
| 2014/0231294 | A1 | 8/2014 | Weder | |

OTHER PUBLICATIONS

Weyand, T., Written Opinion for International Patent Application No. PCT/US2014/072948, dated Apr. 14, 2015, European Patent Office.

Nickitas-Etienne, A., International Preliminary Report on Patentability for International Patent Application No. PCT/US2014/072948, dated Jul. 5, 2016, The International Bureau of WIPO.

* cited by examiner

DECORATIVE GIFT BAG INSERT

CROSS REFERENCE TO RELATED APPLICATIONS

The present application claims the benefit of and priority to U.S. Provisional Patent Application Ser. No. 61/922,956, filed Jan. 2, 2014, and the contents of which are hereby incorporated by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to the field of paper products, and more particularly, are related to inserts for gift bags having a decorative top portion extending therefrom.

Description of the Related Art

Gifts are traditionally given to others on a variety of occasions, ranging from holidays and birthdays to graduations and weddings. The tradition has long been to festively wrap such gifts prior to giving them. In recent years, there has been a growing trend to insert the gifts into appropriately-sized gift bags instead of individually wrapping the gifts. However, in order to conceal the gift items in the bag and maintain an element of surprise for the receiver of the gift, a top layer of wadded-up tissue paper is often inserted. While not unattractive per se, such paper often needs to be purchased in conjunction with the bag, and is generally wasteful of tissue paper. Further, the options for filing the bag are typically limited to paper wadding or gauze-like white tissue paper. Additionally, the use of such paper wadding materials, while sufficiently covering the gifts inside the gift bag, do not offer much interior support to keep the bag from crumbling or deforming during transport, or folding up on itself, unless the tissue paper is used in large quantities. That is, if the tissue paper amount used is too small, the top of the bag often falls over, while large amounts of paper are needed to keep the gift bag upright. In this latter case, the decorative properties of the tissue paper are then lost given the often large amounts needed to obtain structural support of the gift bag.

The inventions disclosed and taught herein are directed to complementary gift bag insert materials that provide both decoration and structural support for the bag when in place.

BRIEF SUMMARY OF THE INVENTION

The objects described above and other advantages and features of the invention are incorporated in the application as set forth herein, and the associated appendices and drawings, related to assemblies for enhancing the appearance and physical stability of a gift bag.

In accordance with a first embodiment of the present disclosure, a device for enhancing the appearance and physical stability of a gift bag is described, the device comprising a flat sheet member having a length, a bottom end and a spaced apart top end, the ends oriented generally parallel to each other, the sheet member having a first compressed storage configuration and a second expanded display configuration; a plurality of strips cut into the sheet member and extending from the top end of the sheet member toward the bottom end of the sheet member, the strips having a length that is less than the overall length of the sheet member; and a bottom region of the sheet member extending from the end point of the strips to the bottom end of the sheet, wherein the strips are in a shape selected from the group consisting of geometric shapes, holiday shapes, and commercial product shapes, wherein when the sheet member is arranged in the expanded display configuration, the sheet member defines a bag-insertion configuration; wherein when positioned into the bag-insertion configuration, the sheet member may be inserted into a bag having a generally planar bottom panel and at least one side wall such that at least a portion of the bottom region of the sheet member is disposed substantially parallel to the side wall, and wherein the plurality of strips extend upwardly from and out of the bag and interweave with each other so as to provide concealment of the identity of a gift placed within the bag.

In accordance with a further embodiment of the present disclosure, a device for enhancing the appearance and physical stability of a gift bag is described, the device comprising a flat sheet member having a length, a bottom end and a spaced apart top end, the ends oriented generally parallel to each other, the sheet member having a first compressed storage configuration and a second expanded display configuration; a plurality of strips cut into the sheet member and extending from the top end of the sheet member toward the bottom end of the sheet member, the strips having a length that less than the overall length of the sheet member; and a bottom region of the sheet member extending from the end point of the strips to the bottom end of the sheet, wherein the strips having at least one wave zone along a length of the strip having ridges with valleys therebetween, wherein when the sheet member is arranged in the expanded display configuration, the sheet member defines a bag-insertion configuration; and wherein when positioned into the bag-insertion configuration, the sheet member may be inserted into a bag having a generally planar bottom panel and at least one side wall such that at least a portion of the bottom region of the sheet member is disposed substantially parallel to the side wall, and the plurality of strips extend upwardly from and out of the bag.

In accordance with aspects of this embodiment, the sheet member is made of paper. In accordance with further aspects of this embodiment, the paper has a density ranging from about 0.020 lb/in$^3$ (0.58 g/cm$^3$) to about 0.055 lb/in$^3$ (1.52 g/cm$^3$), or in the alternative a density ranging from about 27 lb (40 gsm) to about 100 lb (150 gsm) paper density.

In accordance with yet another embodiment of the present invention, a system for mechanically stabilizing and aesthetically enhancing an open-topped gift bag having at least one side panel and a bottom panel is described, the system comprising a flat sheet member having a length, a bottom end and a spaced apart top end, the ends oriented generally parallel to each other, the sheet member having a first compressed storage configuration and a second expanded display configuration; a decoration portion comprising a plurality of strips cut into the sheet member and extending in a direction opposite the bottom end, the strips having a length that is less than the overall length of the sheet member; and a support structure having an elongated portion of the sheet member extending from the end point of the strips to the bottom end of the sheet and connected to the decoration portion, wherein the strips having at least one wave zone along a length of the strip having ridges with valleys therebetween, wherein when the sheet member is arranged in the expanded display configuration, the sheet member defines a bag-insertion configuration; and wherein the support structure is sized to fit into the gift bag such that at least a portion of the support structure is disposed substantially parallel to the side wall and is positioned below the open top of the gift bag, and the decoration portion extends above the open top of the gift bag. In accordance with aspects of this embodiment, the gift bag is a generally rectangular-shaped gift bag. In accordance with further aspects of this embodiment, the support structure and the decoration structure are made of paper.

In accordance with further embodiments of the present invention, a decorative gift bag system is described, the system comprising a gift bag portion; and a bag insert portion operationally insertable into the interior of the gift bag portion; wherein the gift bag further comprises: a generally rectangular base panel; a first pair of spaced apart generally rectangular side panels extending upwardly from the base panel and oriented generally parallel to each other; and a second pair of spaced apart generally rectangular side panels extending upwardly from the base panel and oriented generally parallel to each other and generally perpendicular to the first pair of space apart side panels; wherein the first and second pair of side panels intersect to define a bag volume; and wherein the bag insert portion further comprises: a flat sheet member having a length, a bottom end and a spaced apart top end, the ends oriented generally parallel to each other; a plurality of strips cut into the sheet member and extending from the top end of the sheet member toward the bottom end of the sheet member, the strips having a length that is less than the overall length of the sheet member; and a bottom region of the sheet member extending from the end point of the strips to the bottom end of the sheet.

In accordance with aspects of this embodiment, the strips have at least one wave zone along a length of the strip having ridges with valleys therebetween. In still further aspects, the strips further comprise one or more ridges and valleys forming arcs when projected on an X-Y plane of a three dimensional, X-, Y-, Z-direction system in which the X-direction coincides with a width of the wave zone, and the Y-direction coincides with the longitudinal direction of the wave zone. In select aspects, the wave zone can extend along the entire length of the strip.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
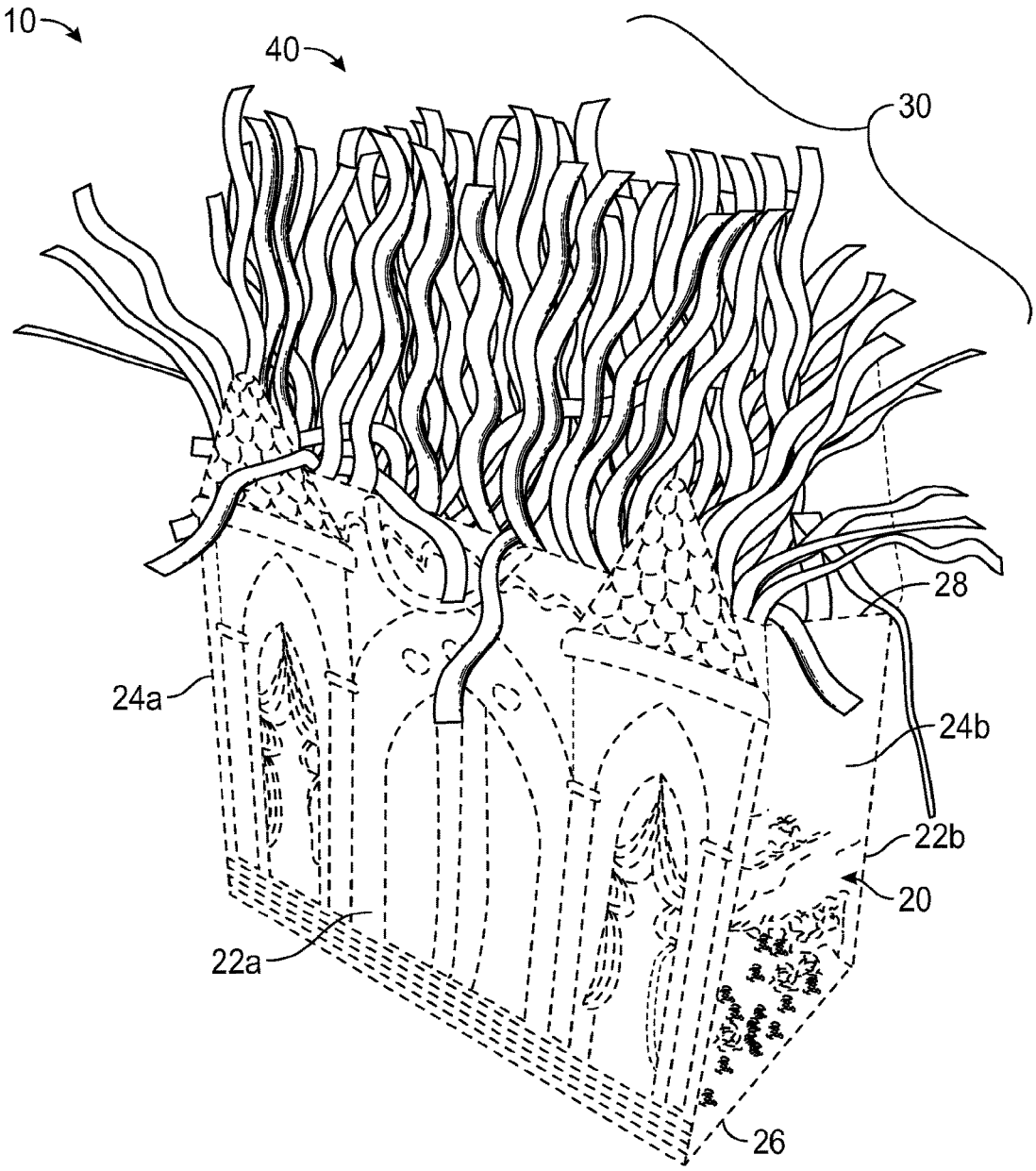
FIG. 1 illustrates a perspective view of a first embodiment of the present invention.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created a decorative support system that provides support to a gift bag while simultaneously providing both decoration and improved coverage of a gift contained within the gift bag by way of a plurality of fingers, or shaped strips, extending from the upper end of the decorative support sheet.

Turning now to the figures, FIG. 1 is a perspective view of an embodiment of the present disclosure, illustrating a gift bag system 10 including the decorative and supportive insert 30 that provides stability to gift bag 20 while also providing a decorative top section 40 for preventing a gift recipient from prematurely viewing a gift contained therein by covering the gift from the inside while being simultaneously decorative.

Typically, the bag 20 has a generally rectangular cross-section, and more typically includes a rectangular base panel 26 and two pairs of spaced and generally parallel panels 22*a*, 22*b* and 24*a*, 24*b* extending therefrom, each respective pair 22*a*, 24*a* and 22*b*, 24*b* oriented generally perpendicularly to one another, and intersecting with each other to define an interior volume 28. Typically, one pair of panels 22*a*, 22*b* (front and back panels) is wider than the other pair of panels 24*a*, 24*b* (side panels). Thus, the bag 20 is encouraged to maintain a generally rectangular 'present box' appearance, which is accentuated by the decorative top section 30 on the top region of supportive insert 40.

Figure 2:
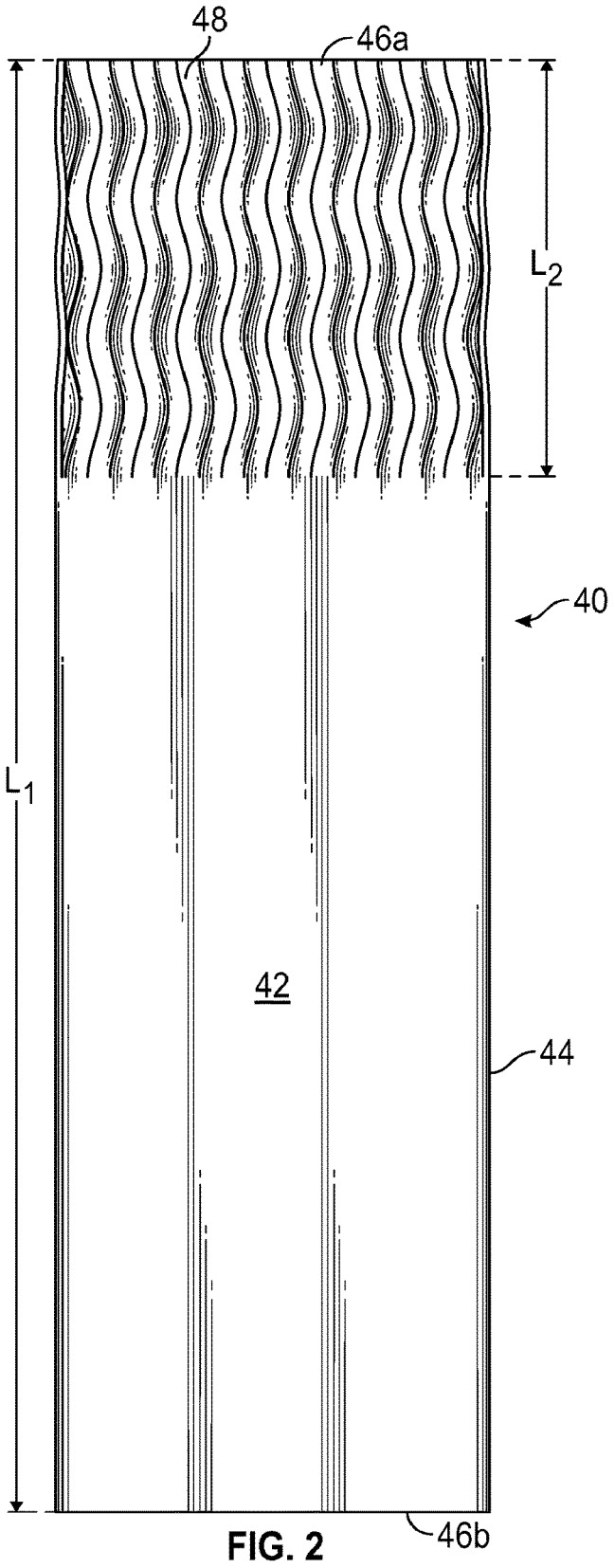
FIG. 2 illustrates a front view of an exemplary decorative sheet member in accordance with the present invention.
Figure 3:
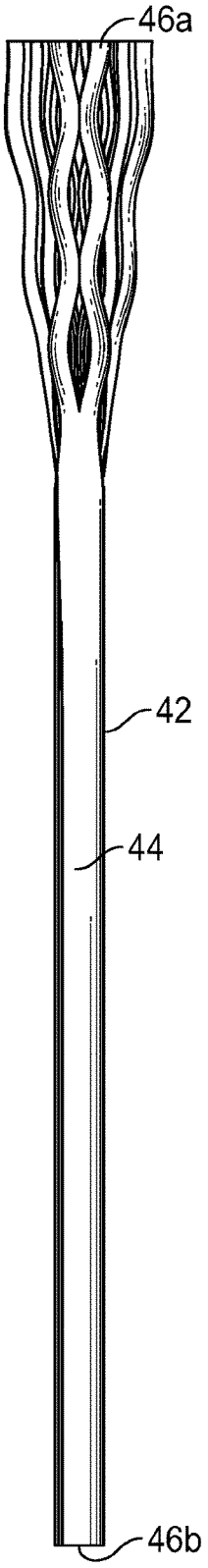
FIG. 3 illustrates a side view of the sheet member of FIG. 2.
Figure 9:
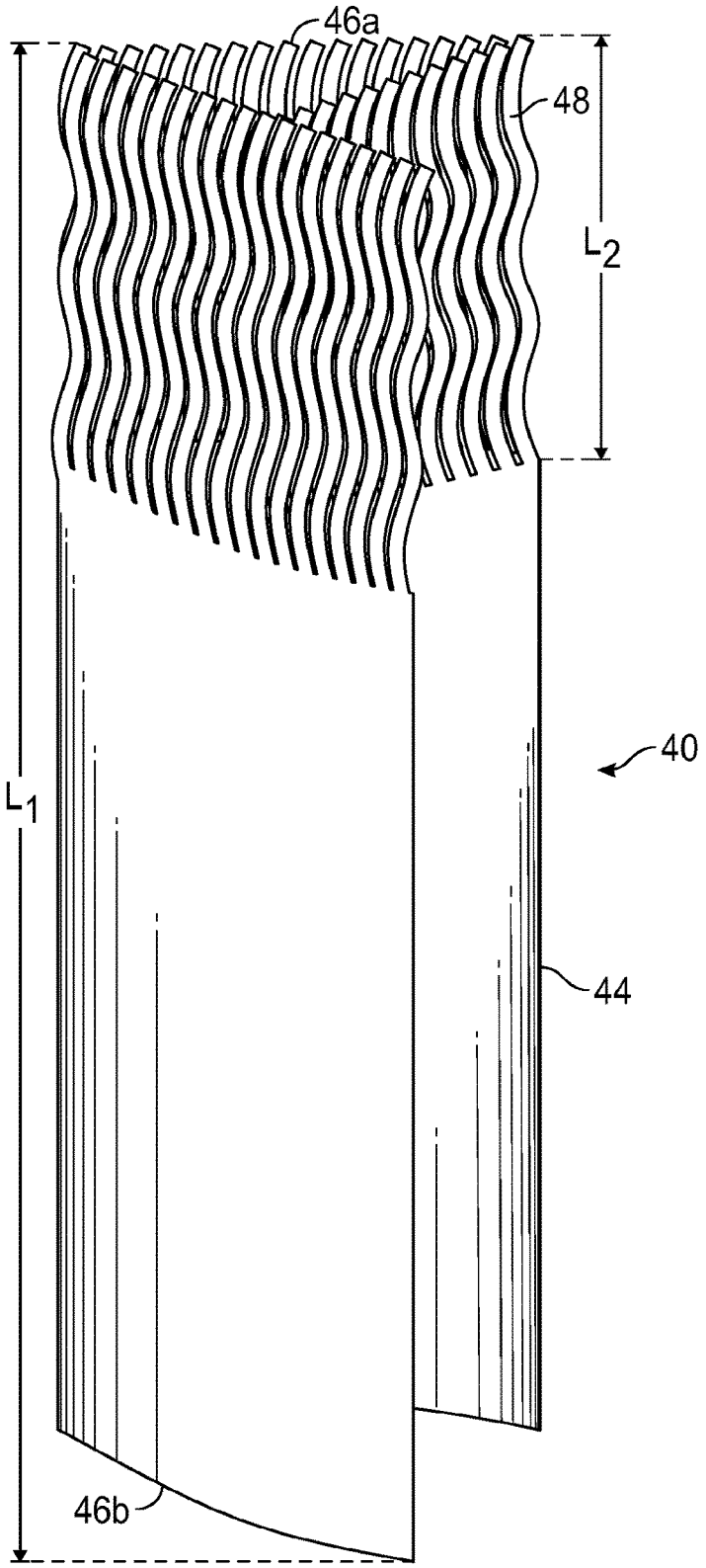
FIG. 9 illustrates a perspective view of an exemplary decorative sheet member in accordance with the present invention.

As illustrated generally in the planar and side views of the folded insert 40 in FIG. 2, FIG. 3, and FIG. 9 the insert 40 is typically an elongated and relatively wide thin flat member generally having a flattened rectangular shape. The insert 40 has a front face 42 (and opposite, planar back face, not shown), and comprises a plurality of faces parallel to the front face 42 formed by repeatedly folding a large sheet of starting product material, such as folding it back and forth or over against itself, so as to provide a material of a desired width. The insert 40 includes long edges 44 and opposite, spaced apart top and bottom ends 46*a*, 46*b*. Formed (such as by cutting or stamping) into top end 46*a* are a plurality of decorative element strips 48. The element strips 48 may be press-cut or roll-cut. The element strips 48 may be formed before or after insert 40 is folded. FIG. 2 illustrates an exemplary decorative sheet member with element strips 48, which were formed before being folded. FIG. 9 illustrates an exemplary decorative sheet member with element strips 48 formed, which were formed after being folded. The element strips 48 may be formed with straight or curved lines. The insert 40 has an overall length $L_1$ that may be adjusted to fit various sized gift bags 20 by either cutting it proximate the bottom end 46*b*, or by folding the insert so as to shorten the overall length $L_1$ of the insert. The decorative strips 48 extend from the top end 46*a* toward the opposite, parallel bottom end 46*b* a distance $L_2$, with $L_2$ being any suitable length provided it is less than the overall length $L_1$ of the insert. In accordance with aspects of the present invention, $L_2$ is less than or equal to about half (50%) of the length of the overall length $L_1$; in accordance with further aspects of the present invention, $L_2$ is less than or approximately equal to about ⅓ of the overall length $L_1$. The insert 40 is typically made of paper of an appropriate weight or density, although it may be made of any convenient structural material, such as cardboard or a polymeric material, so long as the insert retains the ability to provide strength and support to the gift bag, holding it open while simultaneously allowing the decorative element strips 48 to fall randomly so as to provide added coverage to a gift contained therein.

Figure 10:
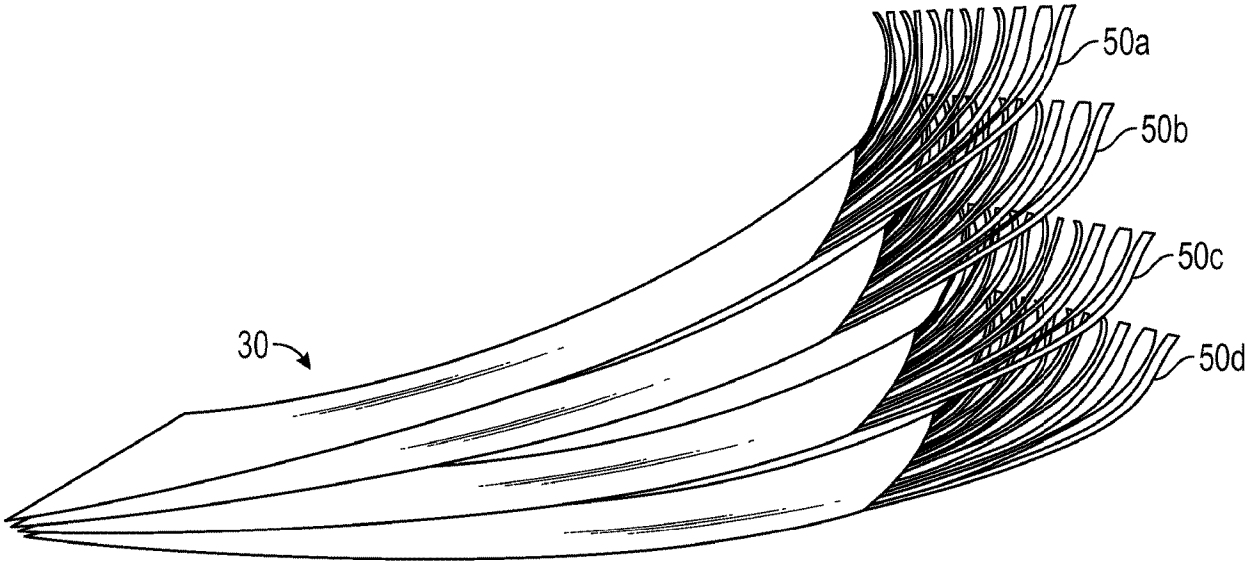
FIG. 10 illustrates a perspective view of a gift bag insert with multiple sheet members in accordance with the present invention.
Figure 11:
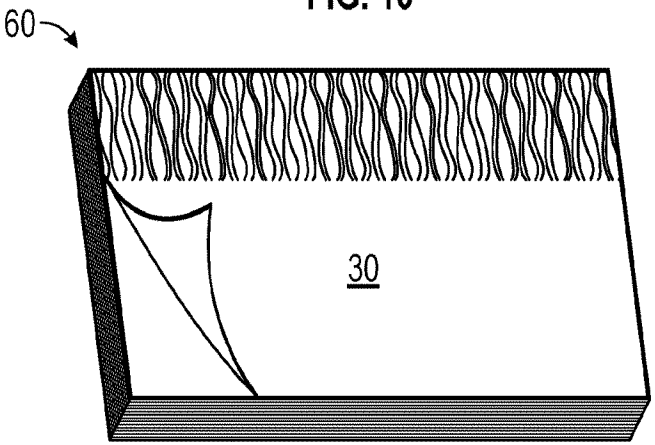
FIG. 11 illustrates a perspective view of a pad of inserts in accordance with the present invention.

Insert 40 is preferably made of paper or any similar material, providing that it has the appropriate thickness, or density, to be suitable to provide both support to the gift bag 20 and cover the gift from the inside of the bag. In accordance with the present invention, the material used for insert 40 is a paper material that has a density ranging from about 0.020 lb/in$^3$ (0.58 g/cm$^3$) to about 0.055 lb/in$^3$ (1.52 g/cm$^3$), or alternatively a paper having a "paper density" ranging from about 27 lb (40 gsm) to about 100 lb (150 gsm). As will be understood by those of skill in the art, "paper density" is not a true density in the traditional sense of mass per unit volume, but rather is a measure of the area density, where the density is measured in "grams per square meter" (gsm, or g/m$^2$). The insert 40 may include one or more sheets of one or more different thicknesses, densities, or materials to provide strength and support to the gift bag, holding it open while simultaneously allowing the decorative element strips 48 to fall randomly so as to provide added coverage to a gift contained therein. FIG. 10 illustrates a perspective view of a gift bag insert 40 with multiple sheet members (50*a*, 50*b*, 50*c*, 50*d*) in accordance with the present invention. The sheets of the insert 40 may be made in different colors. Alternatively, the insert 40 may include one or more inserts manufactured in a pad 60, whereby one or more inserts 30 may be torn from the pad. FIG. 11 illustrates a perspective view of a pad 50 of inserts 30 in accordance with the present invention. Each insert 40 may have a perforated edge that assist in the removal from the pad 60.

Figure 4:
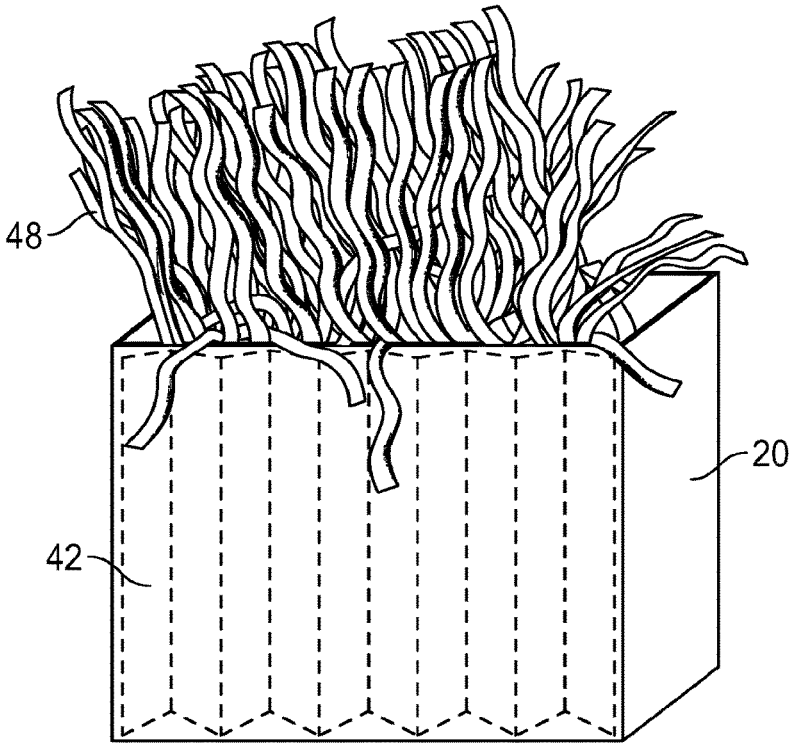
FIG. 4 illustrates a perspective view of an exemplary sheet member in an expanded configuration.

FIG. 4 illustrates generally the insert 40 in its expanded form within bag 20. As shown therein, when insert 40 is unfolded and placed into gift bag 20, the plurality of faces 42 extend the length and width of the interior volume 28 of the bag, thereby providing support and aiding to hold the bag open. As is also shown, when inserted into a gift bag with a gift (not shown), the plurality of decorative strips 48 fall randomly across and out of the top of the gift bag 20, thereby providing additional coverage of the gift contained within the bag, while simultaneously providing a decorative effect. As is also shown, the thickness of each strip 48 may be equal or thickness of one or more each strip 48 may be different to provide strength and support to the gift bag, holding it open while simultaneously allowing the decorative element strips 48 to fall randomly so as to provide added coverage to a gift contained therein. As is also shown, the strip 48 may also have a non-uniform thickness to provide strength and support to the gift bag, holding it open while simultaneously allowing the decorative element strips 48 to fall randomly so as to provide added coverage to a gift contained therein In the embodiment illustrated in FIGS. 5-6, details of a wave-shaped strip product 48, more particularly a comparatively narrow strip shaped product, is shown. The material preferably consists of a cut, paper material of a density in the range as detailed above, but also other materials can be used, such as blown polymer film materials and other similar polymeric materials, provided the material can be cut and shaped, and will provide support to the gift bag when inserted. Further, while the decorative elements 48 are shown having a wave shape in accordance with one aspect of the invention, and a zig-zag shape in accordance with a further aspect of the invention, it will be appreciated that a myriad of shapes can be used without departing from the scope of the invention, including but not limited to each strip 48 containing one or more festive shapes such as stars, one or more holiday-themed elements such as Christmas trees or hearts, one or more animal silhouettes, one or more animated character silhouettes, and the like.

Figure 5:
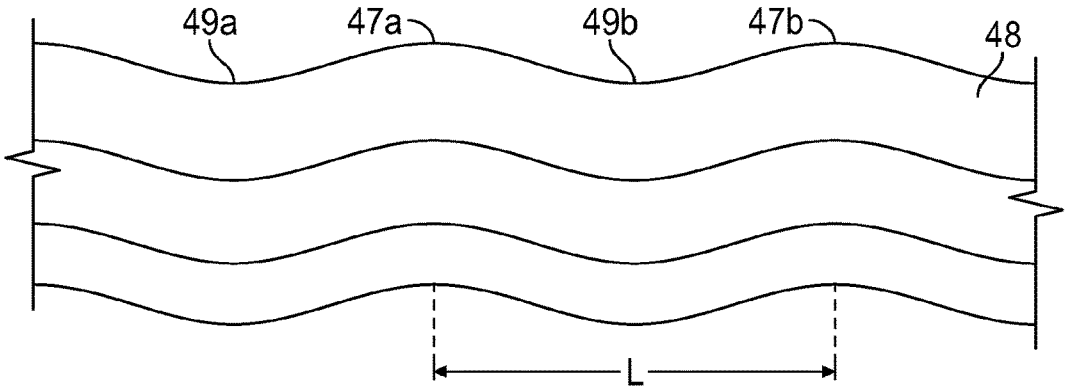
FIG. 5 illustrates a sectional view of a strip in accordance with aspects of the present invention.
Figure 6:
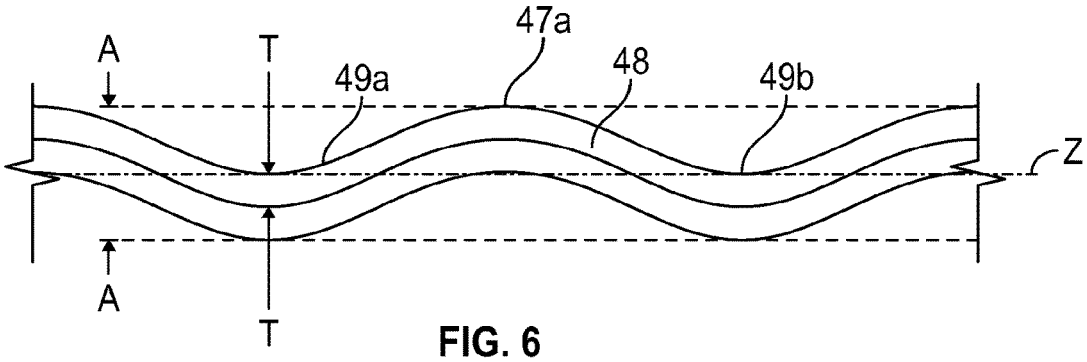
FIG. 6 illustrates a further sectional view of a strip in accordance with aspects of the present invention.

The material has a flat basic form according to the embodiment shown in FIGS. 5 and 6, as well as according to other embodiments of the present invention. The decorative element pattern is superimposed and cut from this flat basic form, and has according to the embodiment shown in FIGS. 5-6 the shape of identically shaped ridges 47*a*, 47*b*, 47*c* . . . 47*n* which alternate with valleys 49*a*, 49*b*, 49*c* . . . 49*n* and are continuously repeated along the length of strip 48. The zero-plane of strip 48 has been designated "Z" in FIG. 6. The zero-plane Z according to the embodiment corresponds to the center plane of the flat starting material and with the X-Y-plane in a conceived three dimensional coordinate system having the X-direction perpendicular to the longitudinal direction of the strip, the Y-direction coinciding with the longitudinal direction of the strip, and the Z-direction perpendicular to the zero-plane. Further, the Y-Z-plane coincides with a longitudinal plane of symmetry of strip 48.

The center line of the strip forms a waved curve in a section coinciding with a plane of symmetry as in each section parallel with this Y-Z-plane, more particularly a sine-wave curve which symmetrically alternates about the zero-plane Z. The amplitude A of the wave thus corresponds to the depths. The strip thickness has been designated T. The strip thickness T may be equal for each strip 48 in the insert 40 or the strip thickness for one or more of each strip 48 may be different to provide strength and support to the gift bag, holding it open while simultaneously allowing the decorative element strips 48 to fall randomly so as to provide added coverage to a gift contained therein. The strip thickness T may also have a non-uniform thickness to provide strength and support to the gift bag, holding it open while simultaneously allowing the decorative element strips 48 to fall randomly so as to provide added coverage to a gift contained therein. The wave length of the sine-wave is designated L. As is thus evident from these figures, the decorative element strips 48 have at least one wave zone along a length of the strip having ridges with valleys therebetween.

The strips further comprise one or more ridges and valleys forming arcs when projected on an X-Y plane of a three dimensional, X-, Y-, Z-direction system in which the X-direction coincides with a width of the wave zone, and the Y-direction coincides with the longitudinal direction of the wave zone, the wave zone extending along the entire length of the strip. In accordance with aspects of this embodiment, each of the arcs and valleys together are about ⅓ of the overall wave height of the strip 48.

Figure 7:
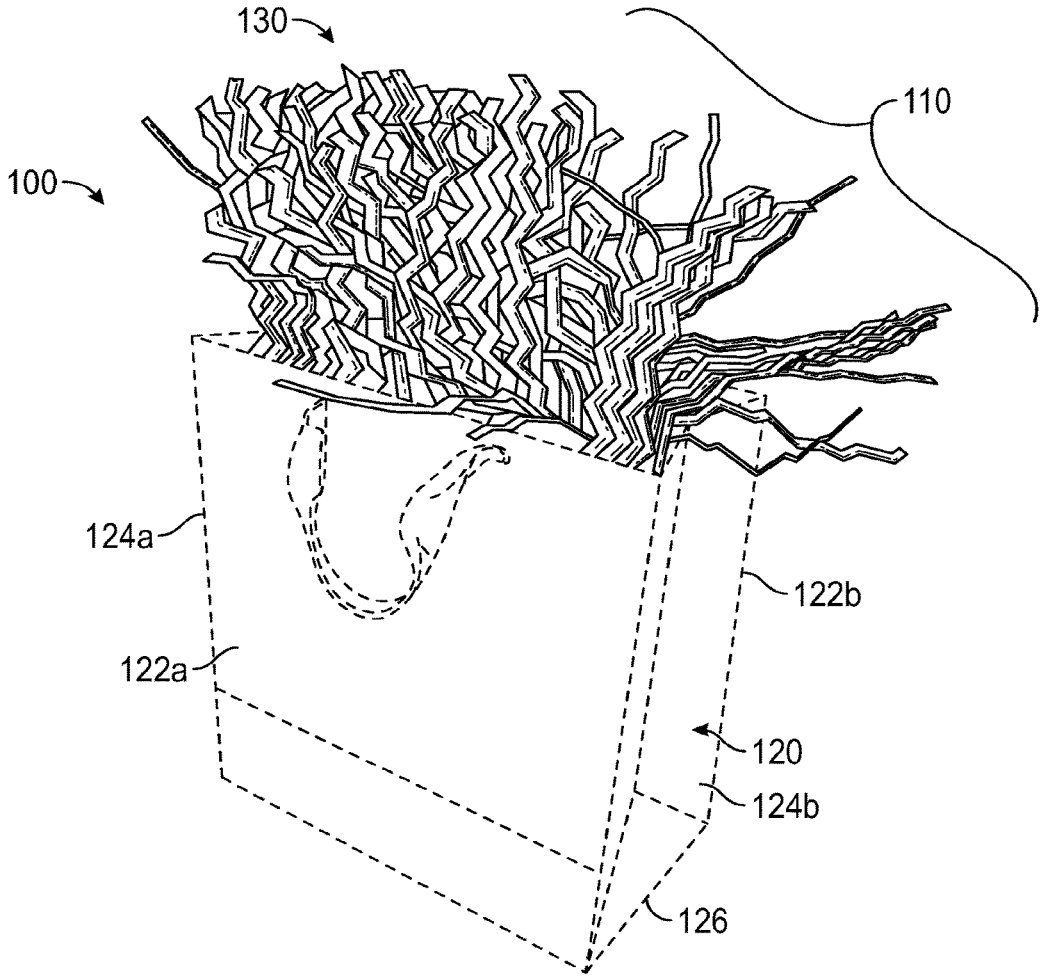
FIG. 7 illustrates a perspective view of a further embodiment gift bag support and decoration assembly in accordance with the present invention.
Figure 8:
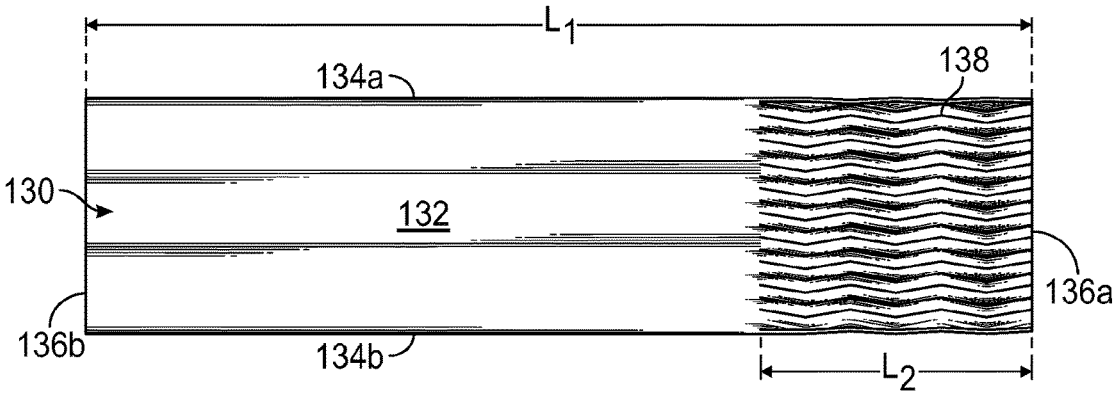
FIG. 8 illustrates a front view of the decorative sheet member of FIG. 7.

FIG. 7 illustrates a perspective view of an alternative embodiment of the present invention, showing a stability enhancing insert 130 within a gift bag 120, wherein the decorative strips on the upper end are in a zig-zag pattern. FIG. 8 illustrates a plan view of a folded sheet of the decorative insert 130. These figures will be described in combination with each other.

FIG. 7 illustrates an exemplary gift bag system 100 including the decorative and supportive insert 130 that provides stability to gift bag 120 while also providing a decorative top section 138 for preventing a gift recipient from prematurely viewing a gift contained therein by covering the gift from the inside while being simultaneously decorative.

Typically, the bag 120 has a generally rectangular cross-section, and more typically includes a rectangular base panel 126 and two pairs of spaced and generally parallel panels 122*a*, 122*b* and 124*a*, 124*b* extending therefrom, each respective pair 122*a*, 124*a* and 122*b*, 124*b* oriented generally perpendicularly to one another, and intersecting with each other to define an interior volume 128. Typically, one pair of panels 122*a*, 122*b* (front and back panels) is wider than the other pair of panels 124*a*, 124*b* (side panels). Thus, the bag 120 is encouraged to maintain a generally rectangular 'present box' appearance, which is accentuated by the decorative top section 138 on the top region of supportive insert 130.

As illustrated generally in the planar view of the folded insert 130 in FIG. 8, the insert 130 is typically an elongated and relatively wide thin flat member generally having a flattened rectangular shape. The insert 130 has a front face 132 (and opposite, planar back face, not shown), and comprises a plurality of faces parallel to the front face 132 formed by repeatedly folding a large sheet of starting product material, such as folding it back and forth or over against itself, so as to provide a material of a desired width. The insert 130 includes spaced apart, parallel long edges 134*a*, 134*b* and opposite, spaced apart top and bottom ends 136*a*, 136*b*. Formed (such as by cutting or stamping) into top end 136*a* are a plurality of decorative element strips 138, shown here to be in a zig-zag form comprising a plurality of zig-zags within each strip. The insert 130 has an overall length $L_1$ that may be adjusted to fit various sized gift bags 120 by either cutting it proximate the bottom end 136*b*, or by folding the insert so as to shorten the overall length $L_1$ of the insert, as described herein above. The decorative strips 138 extend from the top end 136*a* toward the opposite, parallel bottom end 136*b* a distance $L_2$, with $L_2$ being any suitable length provided it is less than the overall length $L_1$ of the insert. In accordance with aspects of the present invention, $L_2$ is less than or equal to about half (50%) of the length of the overall length $L_1$; in accordance with further aspects of the present invention, $L_2$ is less than or approximately equal to about ⅓ of the overall length $L_1$. The insert 130 is typically made of paper of an appropriate weight or density, although it may be made of any convenient structural material, such as cardboard or a polymeric material, so long as the insert retains the ability to provide strength and support to the gift bag, holding it open while simultaneously allowing the decorative element strips 138 to fall randomly so as to provide added coverage to a gift contained therein.

Other and further embodiments utilizing one or more aspects of the inventions described above can be devised without departing from the spirit of Applicant's invention. For example, while the stability enhancing and appearance enhancing devices described herein are preferably made of paper or similar material, it is envisioned that they may also be manufactured from polymeric materials having similar characteristics so as to produce the same effect. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A device for enhancing the appearance and physical stability of a gift bag, the device comprising:

a flat sheet member having a length, a bottom end and a spaced apart top end, the ends oriented generally parallel to each other, the sheet member having a first compressed storage configuration and a second expanded display configuration;

a plurality of strips cut into the sheet member and extending from the top end of the sheet member toward the bottom end of the sheet member, forming an end point of the strips, the strips having a length that is less than the overall length of the sheet member; and a bottom region of the sheet member extending from the end point of the strips to the bottom end of the sheet, wherein the strips are in a shape selected from the group consisting of geometric shapes, holiday shapes, and commercial product shapes, wherein when the sheet member is arranged in the expanded display configuration, the sheet member defines a bag-insertion configuration; and wherein when positioned into the bag-insertion configuration, the sheet member may be inserted into a bag having a generally planar bottom panel and at least one side wall such that at least a portion of the bottom region of the sheet member is disposed substantially parallel to the side wall and the sheet member is of sufficient thickness and density to keep a top of the bag open, and wherein the plurality of strips extend upwardly from and out of the bag and interweave with each other so as to provide concealment of the identity of a gift placed within the bag.

2. A device for enhancing the appearance and physical stability of a gift bag, the device comprising:

a flat sheet member having a length, a bottom end and a spaced apart top end, the ends oriented generally parallel to each other, the sheet member having a first compressed storage configuration and a second expanded display configuration;

a plurality of strips cut into the sheet member and extending from the top end of the sheet member toward the bottom end of the sheet member, forming an end point of the strips, the strips having a length that is less than the overall length of the sheet member; and a bottom region of the sheet member extending from the end point of the strips to the bottom end of the sheet, wherein the strips having at least one wave zone along a length of the strip having ridges with valleys therebetween, wherein when the sheet member is arranged in the expanded display configuration, the sheet member defines a bag-insertion configuration; and wherein when positioned into the bag-insertion configuration, the sheet member may be inserted into a bag having a generally planar bottom panel, a top, and at least one side wall such that at least a portion of the bottom region of the sheet member is disposed substantially parallel to the side wall, and the plurality of strips extend upwardly from and out of the bag such that the sheet member provides a support structure that keeps the top open.

3. The device of claim 2, wherein the strips having at least one wave zone along a length of the strip having ridges with valleys therebetween.

4. The device of claim 3, wherein the sheet member has a density ranging from about 0.020 lb/in$^3$ (0.58 g/cm$^3$) to about 0.055 lb/in$^3$ (1.52 g/cm$^3$), or alternatively a sheet member density ranging from about 27 lb (40 gsm) to about 100 lb (150 gsm).

5. The device of claim 2, wherein the strips have a length that is about ⅓ or less of the overall length of the sheet member.

6. A system for mechanically stabilizing and aesthetically enhancing an open-topped gift bag having at least one side panel and a bottom panel, the system comprising:

a flat sheet member having a length, a bottom end and a spaced apart top end, the ends oriented generally parallel to each other, the sheet member having a first compressed storage configuration and a second expanded display configuration;

a decoration portion comprising a plurality of strips cut into the sheet member and extending in a direction opposite the bottom end, forming an end point of the strips, the strips having a length that is less than the overall length of the sheet member; and a support structure having an elongated portion of the sheet member extending from the end point of the strips to the bottom end of the sheet and connected to the decoration portion, wherein when the sheet member is arranged in the expanded display configuration, the sheet member defines a bag-insertion configuration;

wherein the support structure is sized to fit into the gift bag such that at least a portion of the support structure is disposed substantially parallel to the side wall and is positioned below the open top of the gift bag, and the decoration portion extends above the open top of the gift bag; and wherein the sheet member is of sufficient thickness and density to keep the top of the bag open.

7. The system of claim 6, wherein the strips having at least one wave zone along a length of the strip having ridges with valleys therebetween.

8. The system of claim 6, wherein the support structure and the decoration structure is paper.

9. The system of claim 6, wherein the strips have a length that is about ⅓ or less of the overall length of the sheet member.

10. A gift bag insert, the gift bag insert comprising:

the gift bag insert operationally insertable into the interior of a gift bag; and wherein the gift bag insert comprises:

a plurality of flat sheet members each having a length, a bottom end and a spaced apart top end, the ends oriented generally parallel to each other, and wherein the sheet members have sufficient thickness and density to keep open a top of the gift bag;

a plurality of strips cut into each of the plurality of flat sheet members and extending from the top end of the plurality of flat sheet members toward the bottom end of the plurality of sheet members, forming an end point of strips, the plurality of strips each having a length that is about ⅓ of the overall length of each of the plurality of sheet members, the strips having at least one curved surface; and a bottom region of each of the plurality of sheet members extending from the end point of the strips to the bottom end of the plurality of sheets.

11. The system of claim 10, wherein the plurality of sheet members are made of paper.

12. The system of claim 11, wherein the paper has a density ranging from about 0.020 lb/in$^3$ (0.58 g/cm$^3$) to about 0.055 lb/in$^3$ (1.52 g/cm$^3$), or alternatively a paper density ranging from about 27 lb (40 gsm) to about 100 lb (150 gsm).

13. The system of claim 11, wherein the strips having at least one wave zone along a length of the strip having ridges with valleys therebetween.

14. The system of claim 13, wherein the strips further comprise one or more ridges and valleys forming arcs when projected on an X-Y plane of a three dimensional, X-, Y-, Z-direction system in which the X-direction coincides with a width of the wave zone, and the Y-direction coincides with the longitudinal direction of the wave zone.

15. The system of claim 13, wherein the wave zone extends along the entire length of the strip.

16. The system of claim 10, wherein the plurality of sheet members are made of a polymeric material.

17. The system of claim 10, wherein the length of the sheet member is adjustable along the length of the bottom region.

18. The system of claim 10, wherein the plurality of bag inserts comprises at least four three bag inserts.

19. The system of claim 10, wherein the plurality of sheet members are made of at least two different materials.

20. The system of claim 10, wherein the plurality of strips are cut after the plurality of flat sheet members are folded into thirds.

* * * * *